United States Patent [19]

Marschak

[11] 3,970,199

[45] July 20, 1976

[54] DISPLAY RACK

[76] Inventor: Howard J. Marschak, 865 W. North Ave., Chicago, Ill. 60622

[22] Filed: Jan. 27, 1975

[21] Appl. No.: 544,335

[52] U.S. Cl. ..... 211/128; 211/188

[51] Int. Cl.[2] ..... A47F 3/14

[58] Field of Search ..... 211/49 D, 126, 128, 211/133, 148, 153, 177, 178 R, 130, 132, 181; 108/27, 32, 101, 159; 206/72, 509, 510, 511, 512, 513

[56] References Cited

UNITED STATES PATENTS

| | | | |
|---|---|---|---|
| 548,273 | 10/1895 | Rouse | 211/177 UX |
| 933,517 | 9/1909 | Worcester | 211/126 |
| 1,957,153 | 5/1934 | Smiley | 211/126 |
| 2,456,929 | 12/1948 | Dee | 211/126 |
| 2,575,919 | 11/1951 | Kautzmann et al. | 211/126 |
| 2,680,522 | 6/1954 | Temple | 211/49 R |
| 2,877,519 | 3/1959 | Propst | 211/148 X |
| 2,934,215 | 4/1960 | Mogulescu et al. | 211/126 |
| 3,110,402 | 11/1963 | Mogulescu | 211/49 D |
| 3,481,486 | 12/1969 | Squires | 211/153 |
| 3,872,974 | 3/1975 | Anstatt | 211/153 X |

FOREIGN PATENTS OR APPLICATIONS

| | | | |
|---|---|---|---|
| 229,018 | 1/1959 | Australia | 211/126 |
| 1,014,442 | 6/1952 | France | 206/72 |
| 963,516 | 7/1964 | United Kingdom | 211/126 |
| 157,573 | 1/1921 | United Kingdom | 211/126 |
| 1,197,157 | 1/1970 | United Kingdom | 211/126 |

*Primary Examiner*—Roy D. Frazier
*Assistant Examiner*—Thomas J. Holko
*Attorney, Agent, or Firm*—Max R. Kraus

[57] ABSTRACT

A display rack so constructed that it may be shipped disassembled and may be readily assembled and interlocked without the use of any tools, bolts, nuts, or extraneous fastening elements. The display rack includes a plurality of shelves or trays each having spaced tracks for supporting a plurality of containers in each track. The shelves or trays are detachably connected to form a tier of such shelves or trays by spacer members which are detachably secured in bores formed in the corners of the trays or shelves. The assembled tier of trays or shelves is detachably supported on an inclined base which supports the tier of trays or shelves in a downwardly and forwardly sloping position so that the containers or cans on the trays or shelves slide forwardly as the foremost can or container is removed by the purchaser. While it is preferred that the tier of trays or shelves be inclined, the same may be formed to provide a horizontal support so that the trays or shelves are in a horizontal position.

12 Claims, 9 Drawing Figures

DISPLAY RACK

BRIEF SUMMARY OF THE INVENTION

One of the objects of this invention is to provide a display rack which may be made of parts which can be packed and shipped or transported in a collapsed condition to occupy a minimum of space and which may be readily assembled and set up without the use of any tools, bolts, nuts or extraneous fastening elements merely by interlocking the parts relative to each other, whereby a display rack is formed of a plurality of trays or shelves arranged one spaced above the other in a tier arrangement.

Another object of this invention is to provide a display rack of the foregoing character provided with a base member which is detachably secured to the bottom tray to support a plurality of trays or shelves in a downwardly inclined forwardly sloping position so that the cans or containers positioned in rows on each tray slide downwardly toward the front of the tray as the foremost container in each row is removed.

Another object of this invention is to provide a display rack in which the shelves or trays may be positioned in a horizontal position.

Another object of this invention is to provide the trays or shelves with ribs spaced at varying distances between each other to provide trays with track spacings of varying widths to accommodate cans or containers of different sizes.

Another object of this invention is to provide a display rack in which any number of trays or shelves may be detachably secured to form a tier of such trays or shelves of any desired height.

Another object of this invention is to provide a very simple and inexpensive rack which may be readily assembled and set up in a minimum of time and with minimum effort without the use of any tools and which may if desired be disassembled in a minimum of time and stored away in a minimum of space.

BRIEF DESCRIPTION OF THE DRAWINGS

In the drawings:

FIGS. 1 THROUGH 7

The display unit shown in FIGS. 1 through 7 will be first described. The entire display unit generally indicated at 10 consists of a plurality of shelves or trays, all of which are of identical construction and each is integrally molded preferably of a plastic material. The trays or shelves can also be fabricated of sheet metal or wire. The shelves or trays are all identified generally at 12, and since all are of identical construction only one will be described in detail.

Figure 6:
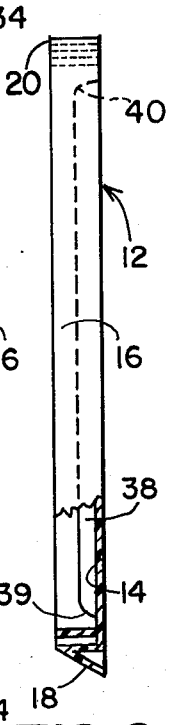
FIG. 6 is a side elevational view with a portion in section of the tray or shelf of FIG. 5.

The shelf or tray 12 comprises a bottom wall 14, spaced side walls 16 and spaced front and rear end walls 18 and 20 respectively, all of which are connected to form a shallow tray or shelf. The front end wall 18 is inclined, as best seen in FIG. 6. At each of the front corners of the tray or shelf there is a boss 22, each having a plurality of spaced vertical bores 24 and 26 extending therethrough, with the bore 24 adapted to detachably receive the ends of the side guards generally indicated at 28. The side guards 28 also serve as spacing members to detachably support and space the trays or shelves 12 with respect to each other.

The opposite rear corners of each of the shelves or trays 12 are likewise provided with bosses 32, each of which is provided with spaced vertical bores 34 and 35. Bore 34 is alined with the front bore 24 to receive the rear end of the side guard. The rear end wall 20 is offset inwardly from the exterior surface of the rear corner bosses 32.

Formed integrally with the bottom wall 14 is a plurality of spaced longitudinally extending vertical ribs 38, the front and rear ends of which ribs are rounded as at 39 and 40 respectively. These spaced ribs form trackways 42 between each pair of ribs 38 for the purpose of supporting cans, bottles, and the like, so that they may slide forwardly, as shown by a representative group of such containers C on the top shelf or tray 12 of FIG. 1. The front ends 39 of the ribs 38 are spaced from the front end wall 18.

Figure 2:
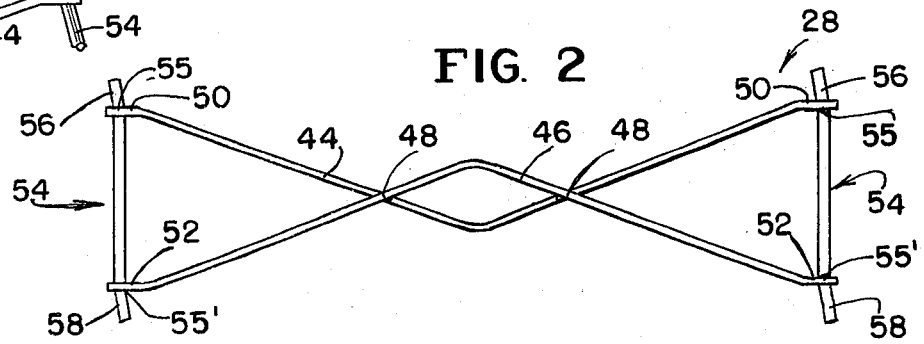
FIG. 2 is an elevational view of one of the side guards.

The shelves or trays 12 are detachably secured in spaced relation, one upon the other as in a tier, by the side guards or spacing members 28, all of which are of identical construction. The side guards or spacing members 28, one of which is best shown in FIG. 2, if formed of a pair of rigid wire members 44 and 46, each of a generally V-shaped configuration, which are secured to each other by brazing or welding as at 48 in an inverted position one with respect to the other. The V-shaped wire member 44 is shaped at each of its opposite ends to form a short horizontal portion 50. The inverted V-shaped wire member 46 likewise has a short horizontal portion 52. A vertically extending wire rod 54 is secured at each of the opposite ends by welding or brazing same as at 55 and 55′ to the horizontal portions 50 and 52.

The upper ends 56 of the vertical rods 54 extend above the horizontal portion 50 and are inclined forwardly and the lower ends 58 of the vertical rods extend below the horizontal portions 52 and are inclined rearwardly. The upper ends 56 are inserted in the bores 24 and 34 through the bottoms thereof at the front and rear of each tray or shelf and the lower ends 58 are inserted in the same bores 24 and 34 through the tops thereof, with the top horizontal portions 50 engaging the underside of the upper tray or shelf and the bottom horizontal portions 52 engaging the tops of the side walls 16 of the lower tray. This spaces the trays or shelves from each other and retains them in a tier.

Figure 1:
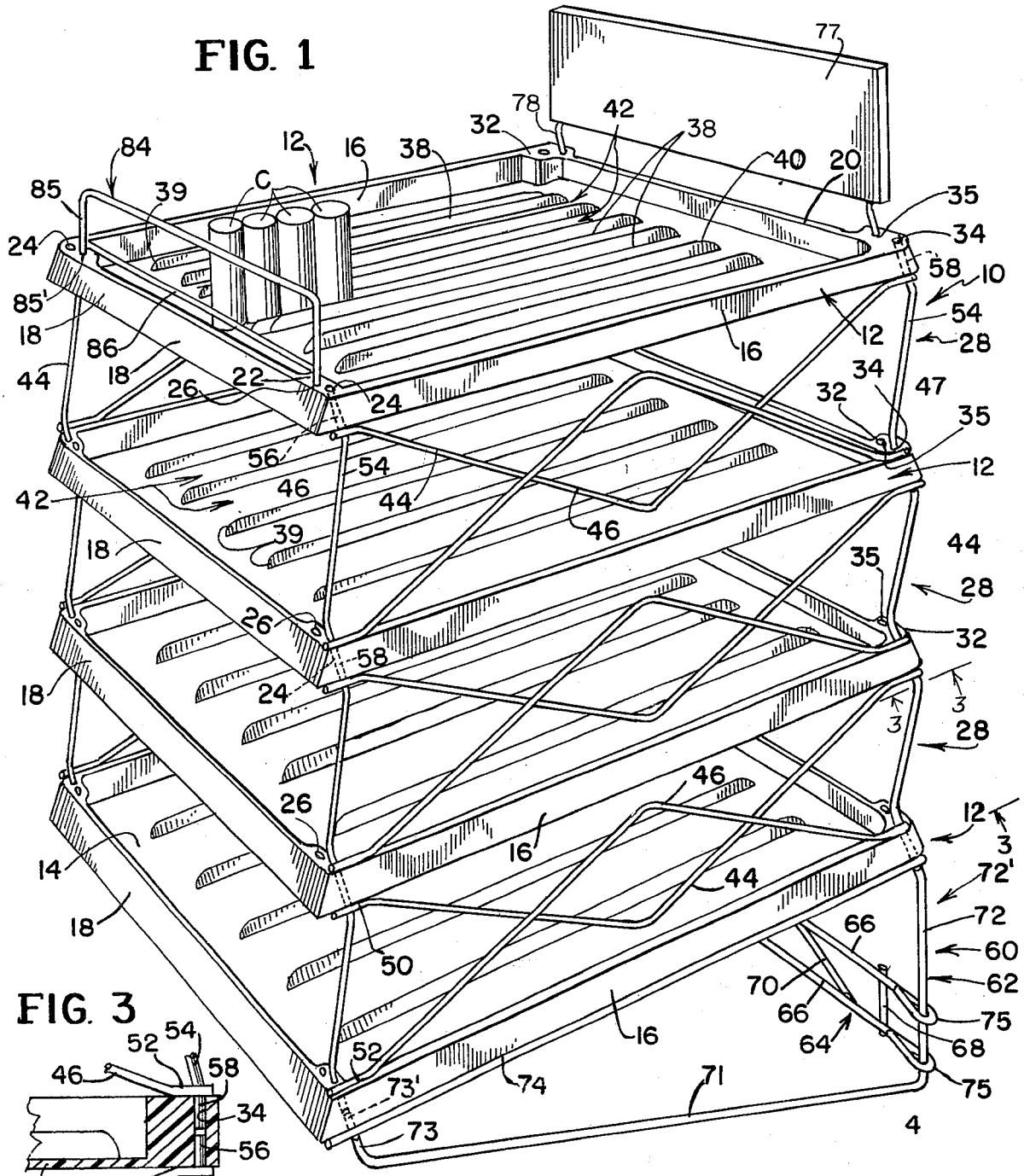
FIG. 1 is a perspective view of the display unit in assembled position.
Figure 3:
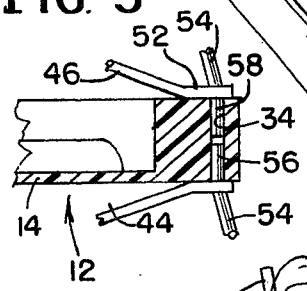
FIG. 3 is a sectional view taken on line 3—3 of FIG. 1.

When one shelf or tray is positioned one above the other, as shown in FIG. 1, to form a tier of trays or shelves, the upper ends 56 of the vertical members 54 of the side guards or spacing members 28 fit into the lower portions of the bores 24 and 34 and the lower ends 58 of the vertical members 54 of another side guard member positioned thereabove fits into the upper portions of the same bores 24 and 34. Thus, each bore 24 and 34 of the tray or shelf receives the upper and lower ends of two separate side guards, as best shown in FIG. 3, to detachably secure the trays or shelves in a tier. The side guards 28 serve as spacing members and also serve to prevent the cans or containers from falling off the display unit at each of the opposite sides and also prevents removal of the containers from either side of the tray or shelf.

Figure 7:
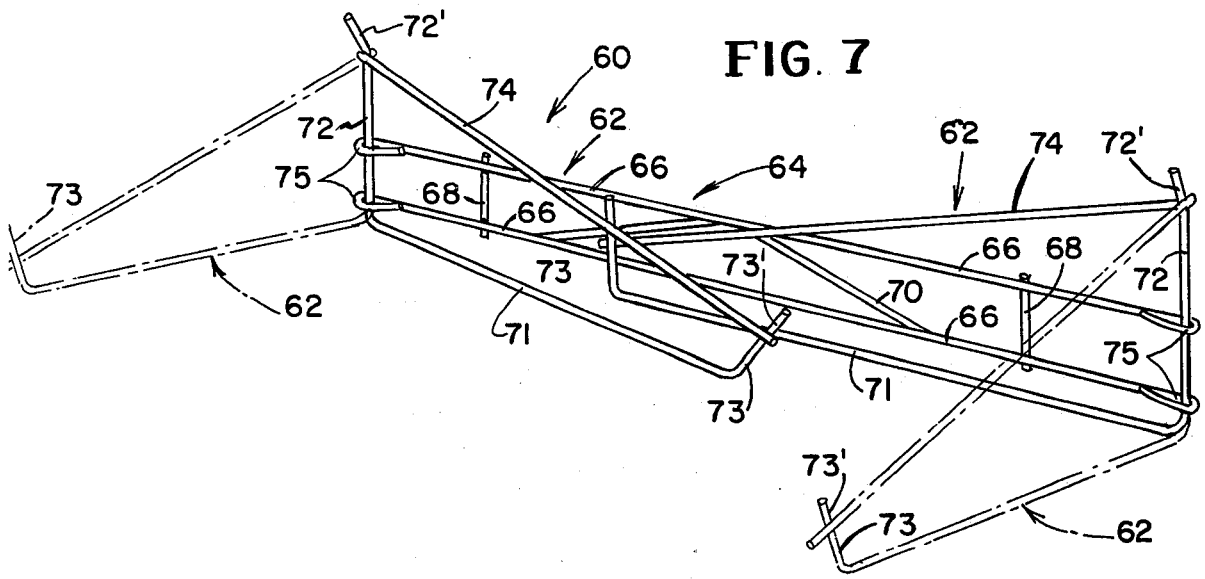
FIG. 7 is a view of the base member with the sides hinged to a collapsed position and also showing in dotted lines the sides in normal base supporting position.

To support the tier of trays or shelves 12 at an inclined angle, as shown in FIG. 1, there is provided a generally triangular-shaped base member generally indicated at 60, best shown in FIG. 7. The base member 60 is formed of a pair of spaced sides generally indicated at 62, hingedly or pivotally secured to a back member 64 so that the sides can be pivoted to their collapsed position, as shown in full lines in FIG. 7, or to their supporting position as shown in dotted lines. The back member 64 is formed of a pair of spaced horizontal wire members 66 connected by spaced vertically extending wires 68 brazed or welded thereto. Diagonally positioned wires 70 are also brazed or welded to the spaced horizontal wires 66. Each of the spaced sides 62 comprises a bottom horizontal portion 71 bent upwardly at the rear to form a rear vertical portion 72 and is bent upwardly at the front to form a front vertical portion 73 of a reduced height. A top wire member 74 is brazed or welded to the vertical wires 72 and 73 at an inclined angle below the top ends of each to provide upper portions 72' and 73' which are inserted in the bores 24 and 34 of the bottom tray so that the bottom tray rests on the inclined top wire member 74. The opposite ends of wire member 66 are looped as at 75 around the rear vertical portions 72 so that the sides 62 may be pivoted or hinged with respect to the back member. The base member 60 may be thus collapsed for shipping or storage, and then with the sides 62 positioned perpendicular to the back portion there is provided a base for supporting a tier of trays, as shown in FIG. 1. The top wire member 74 is at an inclined angle of approximately 18 degrees and this inclination is sufficient to permit the cans or containers C to slide gently forward as the foremost can or container between each pair of ribs 38 is removed.

A header indicated at 77 which carries advertising material or designates the products on the trays or shelves has a pair of downwardly extending rigid wires 78 secured to the top tray, as shown in FIG. 1, by inserting the wires 78 into the bores 35.

Figure 4:
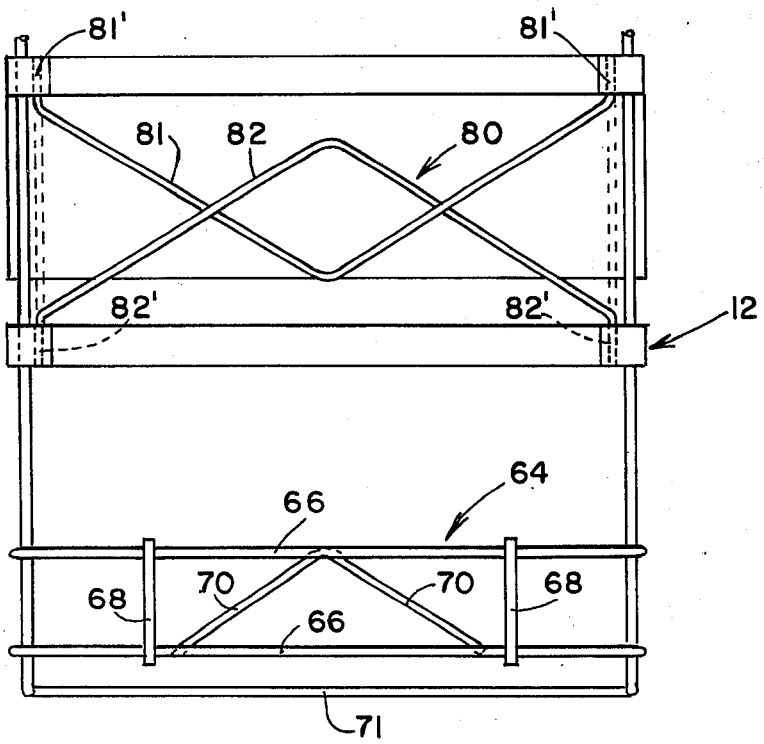
FIG. 4 is a rear elevational view of the base and one of the tray or shelf units.
Figure 5:
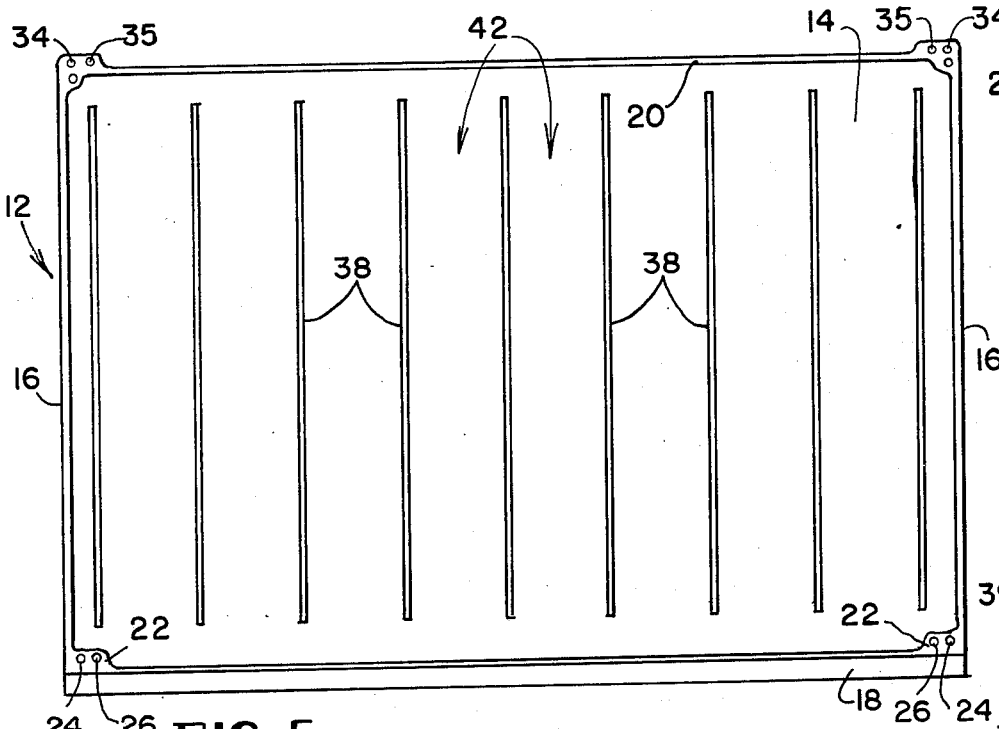
FIG. 5 is a top plan view of one of the trays or shelves.

An anti-sway brace generally indicated at 80 is detachably secured at the rear between a pair of trays or shelves, one of which is shown in FIG. 4. The anti-sway brace is formed of a pair of V-shaped wire members 81 and 82, one inverted with respect to the other and brazed or welded to each other. Wire member 81 has upturned vertical ends 81' and wire member 82 has downturned vertical ends 82'. The said vertical ends are inserted in the bores at the rear of the trays or shelves to anchor and secure the anti-sway brace 80 to the spaced trays or shelves and to provide additional support for the tier of trays.

While for the purpose of this illustration the trays or shelves are equally spaced from each other, it will be understood that the spacing can be varied and can be increased or decreased from that shown by having higher or shorter side guards or spacing members 28. If desired, a front guard rail generally indicated at 84 is detachably secured to the bores 26 at the front of the tray or shelf. Only one of such front guard rails 84 is shown attached to the uppermost tray, however, each tray may have a similar front guard secured thereto. The front guard rail 84 is of an inverted U-shaped configuration having spaced sides 85 with the ends 85' of the sides extending into the bores 26. A bottom crossbar 86 is welded or brazed to the sides 85.

As can be appreciated, the trays or shelves 12 are shipped detached or demounted from the side guards 28, rear anti-sway braces 80 and base 64 so that a minimum of space is occupied in a shipping carton or container. The base 64 is collapsed as shown in full lines in FIG. 7. The side guards 28 can be readily assembled and attached to the trays or shelves to form the spaced arrangement between trays or shelves, as shown, and then mounted on the base. The unit may be assembled in a relatively short time without the use of any extraneous fastening elements or tools and can be assembled by merely inserting the upper and lower ends of the side guards 28 in their respective openings or bores.

The longitudinally extending ribs 38 in each of the trays may be spaced at different widths between each other so that one tray can accommodate a can or container of a certain circumference while another tray can accommodate containers having a greater or lesser circumference. While the side guards 28, rear sway brace 80 and the base 64 are shown formed of rigid wires, it will be understood that each of them may be molded of a plastic material having sufficient strength and ridigity in the shapes shown for each.

While the base is shown at an inclined angle, it is also within the purview of this invention to provide a base which has a horizontally positioned top wire so that the trays or shelves are all supported in a horizontal position. To accomplish this purpose the rear and front vertical wire portions 72 and 73 of the side members 62 should be of the same height and the top wire 74 is secured thereto in a horizontal position, instead of being inclined as shown in FIG. 7.

The spacing between the ribs 38 in the trays may be varied to provide trackways of varying widths to accommodate cans or containers of varying diameters. For example, one tray or shelf may have the ribs spaced differently from that of another tray so that the user can combine these various trays in a tier to serve the desired purpose.

Figure 8:
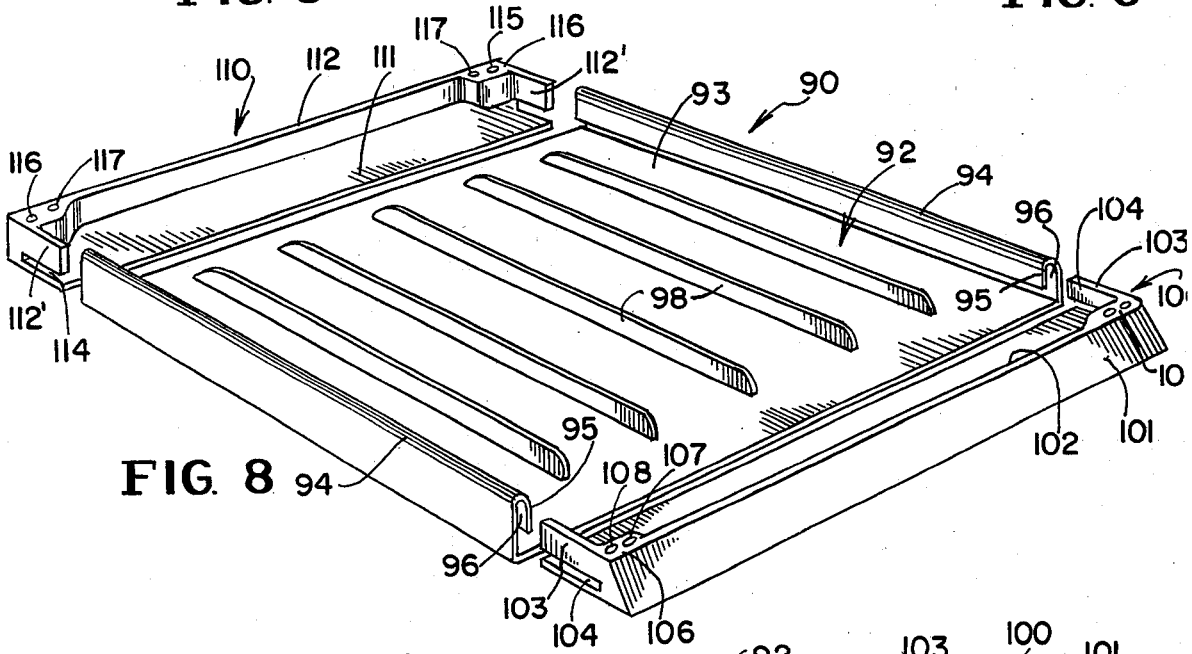
FIG. 8 is an exploded view of a modified tray or shelf.
Figure 9:
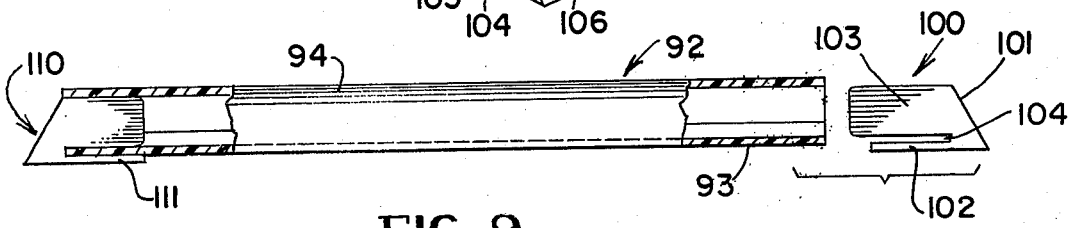
FIG. 9 is a side view partly in section of the tray or shelf shown in FIG. 8.

FIGS. 8 and 9

FIGS. 8 and 9 show a modified tray or shelf which is molded of plastic material and molded in three sections and then assembled to form an integrated tray or shelf, generally indicated at 90, which comprises a main central portion 92 comprising a bottom wall 93 with spaced upwardly extending sides 94, which sides are curved inwardly at their tops and continue downwardly to form inwardly extending spaced flanges 95 so that each of said sides has a generally inverted U-shaped configuration so that the front and rear ends of said sides form channels 96 which are adapted to receive the sides on the front and rear sections.

The main central portion 92 is provided with spaced vertically extending ribs 98, similar to those previously described, with each pair of ribs forming a track for receiving cans or containers. The front section 100 of the tray or shelf includes an inclined front wall 101 with a rearwardly extending bottom wall 102. Extending from the front wall rearwardly on each of the opposite sides is a short side wall 103 which is spaced from the bottom wall 102 to provide a horizontal slot 104, best shown in FIG. 9. The rearwardly extending side walls 103 extend rearwardly of the bottom wall 102.

The front corner ends of the front section have bosses 106, each of which is provided with two spaced vertical bores 107 and 108, similar to the spaced bores 24 and 26 on the trays or shelves previously described. These bores 107 and 108 serve the same purpose, namely, that of receiving the ends of the side guards 28. The rear section 110 comprises a bottom wall 111 which continues upwardly to form a rear end wall 112 which has forwardly extending short sides 112' which are spaced from the bottom wall 111 to provide horizontally extending slots 114. At each of the corners of the rear section 110 is a boss 115 which has two spaced vertical bores 116 and 117 extending therethrough, similar to the two bores 34 and 35 in the rear of the tray or shelf previously described and for the same purpose. The three sections 92, 100 and 110 are assembled to form a unitary tray or shelf by inserting the ends of the front sides 103 into the front channels 96 and with the front of the bottom wall 93 of the main central portion 92 being received in the slots 104 so that the bottom wall 102 of the front section 100 is positioned below the bottom wall 93 when assembled. The rear section 110 is similarly secured to the rear of the main central portion 90 to form a single unitary tray or shelf.

What is claimed is:

1. A display rack which is shipped and stored in a knockdown condition and is readily assembled without the use of extraneous fastening means, said rack comprising, a plurality of trays or shelves arranged to form a tier of same, each said tray or shelf having an opening adjacent each of the corners thereof, spacer side guard members between each pair of adjacent trays or shelves and extending substantially the length of said trays or shelves, each said spacer side guard member having an upwardly and downwardly extending end portion at the front and rear thereof which end portions are adapted to fit into the openings of two adjacent spaced trays or shelves one above the other to detachably support a plurality of trays or shelves in spaced relation one above the other, said spaced side guards having means adjacent said upwardly and downwardly extending end portions which abut against the bottom and top of two adjacent spaced connected trays or shelves in a tier to limit and define the spaced distance between said two spaced connected trays or shelves, a base member on which the bottom tray or shelf is detachably secured, said base member having a rear member and spaced side members which are hingedly or pivotally secured to the rear member so that the side members can be hinged inwardly toward each other to a collapsed position, said side members being positioned perpendicular to said rear member so that the bottom tray or shelf rests on top of said side members and said rear member when said base member supports said trays or shelves.

2. A display rack as set forth in claim 1 in which the base member is detachably secured to the bottom tray or shelf to support the plurality of trays or shelves in a horizontal position.

3. A display rack as set forth in claim 1 in which the trays or shelves each have spaced means to provide a plurality of tracks for receiving containers and the like and in which the tray or shelf has bores at the front thereof for detachably receiving a front guard.

4. A display rack as set forth in claim 1 in which the tray or shelf is molded of plastic and comprises a main tray section, a separate front section, and a separate rear section, with said front and rear section detachably secured to said main tray section.

5. A display rack as set forth in claim 4 in which the main tray section has spaced sides which have inwardly turned flanges providing spaces between the spaced sides and the flanges to detachably receive the spaced sides of the front and rear sections.

6. A display rack as set forth in claim 1 in which said base member has upwardly extending end portions which are adapted to fit into the openings of the bottom tray to detachably secure said bottom tray to said base member.

7. A display rack as set forth in claim 1 in which each of the sides of said base member have a top which is at an inclined angle so that the pairs of trays or shelves are supported in a downwardly inclined position sloping downwardly towards the front of the trays or shelves.

8. A display rack as set forth in claim 7 in which the trays or shelf is molded of plastic and has integrally formed longitudinally extending spaced ribs for forming a plurality of tracks for receiving containers and the like and in which the containers gravitate towards the front of the tray or shelf.

9. A display rack as set forth in claim 1 in which the tray or shelf is molded of plastic and has integrally formed longitudinally extending spaced ribs for forming a plurality of tracks for receiving containers and the like.

10. A display rack as set forth in claim 9 in which each of the spacer side guard members are formed of a pair of rigid wires of a generally V-shaped configuration, one inverted with respect to the other and front and rear vertically extending rigid wires which are secured to said V-shaped wires, with said vertically extending wires having the upwardly and downwardly extending end portions which fit into the openings of the spaced trays or shelves.

11. A display rack as set forth in claim 10 in which the same opening in a tray or shelf receives the downwardly extending end portion of the vertically extending rigid wire of one spacer side guard member and the upwardly extending end portion of another spacer side guard member positioned below in the same tier.

12. A display rack as set forth in claim 1 in which the same opening in a tray or shelf receives the downwardly extending end portion of one spacer side guard member and the upwardly extending end portion of another spacer side guard member positioned below in the same tier.

* * * * *